US011678714B2

(12) United States Patent
Huang

(10) Patent No.: US 11,678,714 B2
(45) Date of Patent: Jun. 20, 2023

(54) MASSAGE INSOLE/SOLE STRUCTURE CAPABLE HAVING BREATHABLE EFFECT

(71) Applicant: Chien-Hsiung Huang, Huwei Township (TW)

(72) Inventor: Chien-Hsiung Huang, Huwei Township (TW)

( * ) Notice: Subject to any disclaimer, the term of this patent is extended or adjusted under 35 U.S.C. 154(b) by 32 days.

(21) Appl. No.: 17/536,349

(22) Filed: Nov. 29, 2021

(65) Prior Publication Data

US 2022/0167706 A1 Jun. 2, 2022

(30) Foreign Application Priority Data

Dec. 2, 2020 (TW) ..... 109215959

(51) Int. Cl.

| | |
|---|---|
| ***A43B 7/1455*** | (2022.01) |
| ***A43B 17/02*** | (2006.01) |
| ***A43B 7/08*** | (2022.01) |
| ***A43B 7/1445*** | (2022.01) |
| ***A43B 7/144*** | (2022.01) |

(52) U.S. Cl.

CPC ..... *A43B 7/146* (2013.01); *A43B 7/081* (2013.01); *A43B 7/144* (2013.01); *A43B 7/1445* (2013.01); *A43B 17/02* (2013.01)

(58) Field of Classification Search

CPC ..... A43B 7/146; A43B 7/06; A43B 7/081
USPC ..... 36/3 R, 3 B, 141
See application file for complete search history.

(56) References Cited

U.S. PATENT DOCUMENTS

| | | | | | |
|---|---|---|---|---|---|
| 1,010,002 | A | * | 11/1911 | Stern | A43B 7/06 36/3 R |
| 1,167,885 | A | * | 1/1916 | Carll | A43B 7/146 36/32 R |
| 5,233,767 | A | * | 8/1993 | Kramer | A43B 13/206 36/35 B |
| 5,235,761 | A | * | 8/1993 | Chang | A43B 3/50 36/137 |
| 5,607,749 | A | * | 3/1997 | Strumor | A43B 13/181 428/313.5 |
| 5,664,342 | A | * | 9/1997 | Buchsenschuss | A43B 17/18 36/43 |
| 5,694,705 | A | * | 12/1997 | Alonso Coves | A43B 7/142 36/141 |
| 5,860,229 | A | * | 1/1999 | Morgenstern | A43B 7/1415 36/141 |

(Continued)

*Primary Examiner* — Marie D Bays
(74) *Attorney, Agent, or Firm* — Karin L. Williams; Alan D. Kamrath; Mayer & Williams PC

(57) ABSTRACT

An insole/sole structure contains: a top pad, two massage column modules, a form pad, and a bottom pad. The top pad includes at least one accommodation groove. A respective one of the at least one massage column module includes a holding portion and multiple flexible massaging columns. The respective one massage column module is connected on the top pad by using the holding portion. The multiple flexible massaging columns are held on the holding portion to correspond to a profile of a respective one accommodation groove. A profile of the foam pad and a profile of the bottom pad correspond to a profile of the top pad, such that when the foam pad and the bottom pad are connected, the foam pad and the bottom pad are closed, and the respective one massage column module is limited between the top pad and the foam pad.

7 Claims, 8 Drawing Sheets

(56) References Cited

U.S. PATENT DOCUMENTS

| | | | | |
|---|---|---|---|---|
| 6,434,859 | B1 * | 8/2002 | Kim | A43B 7/142 36/43 |
| 2004/0006888 | A1 * | 1/2004 | Moretti | A43B 7/06 36/3 B |
| 2013/0104419 | A1 * | 5/2013 | Horesh | A43B 7/141 36/43 |
| 2013/0283638 | A1 * | 10/2013 | Diepenbrock | A43B 13/40 36/44 |
| 2021/0212892 | A1 * | 7/2021 | Seo | A43B 7/146 |

* cited by examiner

MASSAGE INSOLE/SOLE STRUCTURE CAPABLE HAVING BREATHABLE EFFECT

FIELD OF THE INVENTION

The present invention related to an insole/sole structure which contains multiple flexible massaging columns formed on a respective one massage column module, and a respective one flexible massaging column has an air orifice, a foam pad connected on the bottom of the insole/sole structure so that the airs flow between the sole and the heel successively to massage and cool the foot and to absorb vibration, when walking with the insole/sole structure.

BACKGROUND OF THE INVENTION

The structure of the body is quite mysterious. There are thousands of acupuncture points throughout the body, especially the soles of the feet, because everyone uses the soles of the feet in their daily activities. Even some academic journals and papers have pointed out that the soles of the feet are the second heart of humans. Therefore, there are many massage insoles on the market applied to massage the acupoints of the soles of the feet.

However, most of the massage insoles have massage particles. These massage particles are solid structures. When consumers have to stand for a long time due to work, the soles of the feet will feel uncomfortable. Because the aforementioned massage particles continue to stimulate the soles of the feet, they will cause poor blood circulation in the soles of the feet.

Although the massage insoles have good ventilation by using massage particles. However, the soles of the feet are soft tissues, the surrounding muscles supported by the massage particles will hang into the grooves where there are no massage particles. Therefore, the soles of the feet can easily cause embarrassing situations such as foot sweat and foot odor.

The present invention has arisen to mitigate and/or obviate the afore-described disadvantages.

SUMMARY OF THE INVENTION

The primary aspect of the present invention is to provide an insole/sole structure which contains multiple flexible massaging columns formed on a respective one massage column module, and a respective one flexible massaging column has an air orifice, a foam pad connected on the bottom of the insole/sole structure so that the airs flow between the sole and the heel successively to massage and cool the foot and to absorb vibration, when walking with the insole/sole structure.

To obtain above-mentioned aspect, an insole/sole structure provided by the present invention contains: a top pad, two massage column modules, a form pad, and a bottom pad.

The top pad is formed in a foot shape and includes at least one accommodation groove defined on the top pad.

A respective one massage column module of the at least one massage column module includes a holding portion and multiple flexible massaging columns, and the holding portion of the respective one massage column module is configured to hold the multiple flexible massaging columns of the respective one massage column module, the respective one massage column module is connected on a bottom of the top pad by using the holding portion. The multiple flexible massaging columns are held on the holding portion to correspond to a profile of a respective one accommodation groove of the at least one accommodation groove, such that when a respective one flexible massaging column is connected with the top pad, the multiple flexible massaging columns extend out of the respective one accommodation groove of the top pad.

A profile of the foam pad and a profile of the bottom pad correspond to a profile of the top pad, such that when the foam pad and the bottom pad are connected, the foam pad and the bottom pad are closed, and the respective one massage column module is limited between the top pad and the foam pad. The foam pad includes multiple air-permeable bores defined thereon so that when the multiple flexible massaging columns of the respective one massage column module are pressed, airs flow to the foam pad.

When a heel and a sole of a foot step the multiple flexible massaging columns, the multiple flexible massaging columns massage the foot, and the airs flow to the foam pad from the multiple flexible massaging columns successively based on a stepping order to obtain a cooling effect to the foot.

Preferably, a respective one flexible column has an air orifice defined on a center thereof so that the airs flow into the foam pad from the air orifice of the respective one flexible column and discharge out of the massage column module of the sole or the heel of the foot.

Preferably, the top pad has two accommodation grooves corresponding to the sole and the heel of the foot.

Preferably, an accommodation groove is defined on the top pad and corresponds to a profile of a connection of a sole, an arch, and a heel of the foot.

Preferably, the bottom pad is replaced by a shoe sole.

Thereby, when walking on a ground, the heel of the foot steps the ground and the sole of the foot remove from the ground, hence the heel steps the multiple flexible massaging columns so that the airs flow into the foam pad from the air orifice of the respective one flexible column and discharge out of the massage column module of the sole of the foot or a connection surface of the foam pad, the bottom pad, and the top pad. Thereafter, the sole steps the multiple flexible massaging columns so that the airs discharge out of the massage column module of the heel of the foot, thus circulating the airs to cool the foot when walking with the insole/sole structure.

DETAILED DESCRIPTION OF THE PREFERRED EMBODIMENTS

Figure 1:
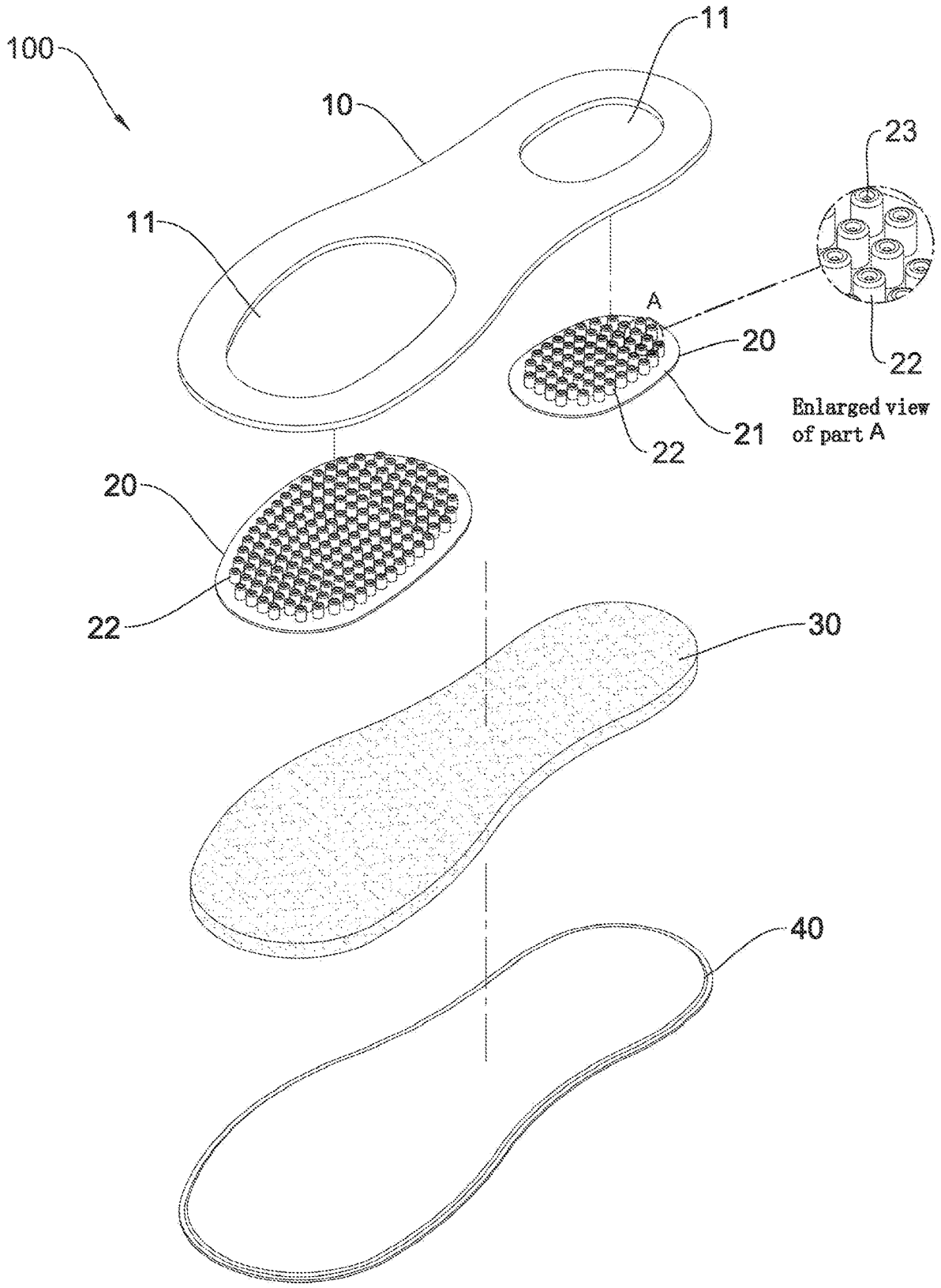
FIG. 1 is a perspective view showing the exploded components of an insole/sole structure according to a first embodiment of the present invention.

With reference to FIGS. 1 to 4, an insole/sole structure 100 according to a first embodiment of the present invention comprises a top pad 10, two massage column modules 20, a form pad 30, and a bottom pad 40.

Figure 2:
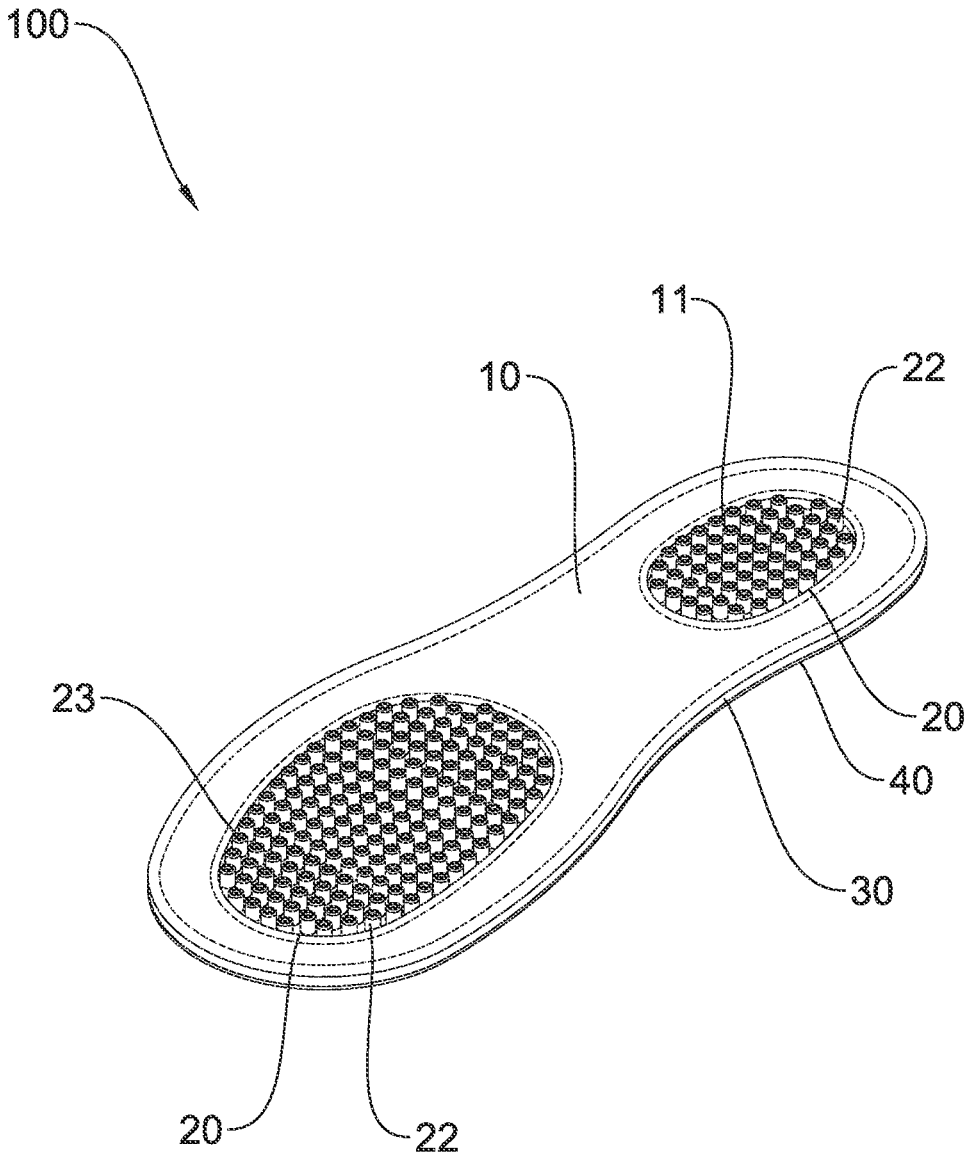
FIG. 2 is a perspective view showing the assembly of the insole/sole structure according to the first embodiment of the present invention.

As shown in FIGS. 1 and 2, the top pad 10 is formed in a foot shape and includes two accommodation grooves 11 corresponding to a sole and a heel of a foot.

Referring to FIGS. 1-4, the two massage column modules 20 are received in the two accommodation grooves 11, wherein a respective one massage column module 20 includes a holding portion 21 and multiple flexible massaging columns 22, wherein a respective one flexible column 22 has an air orifice 23 defined on a center thereof, the holding portion 21 of the respective one massage column module 20 is configured to hold the multiple flexible massaging columns 22 of the respective one massage column module 20, and the respective one massage column module 20 is connected on a bottom of the top pad 10 by using the holding portion 21, wherein the multiple flexible massaging columns 22 are held on the holding portion 21 to correspond to a profile of a respective one accommodation groove 11, such that when the respective flexible massaging column 22 is connected with the top pad 10, the multiple flexible massaging columns 22 extend out of the respective one accommodation groove 11 of the top pad 10 to massage the sole and the heel of the foot when a user walks, and the multiple flexible massaging columns 22 are pressed by the foot to deform.

Figure 3:
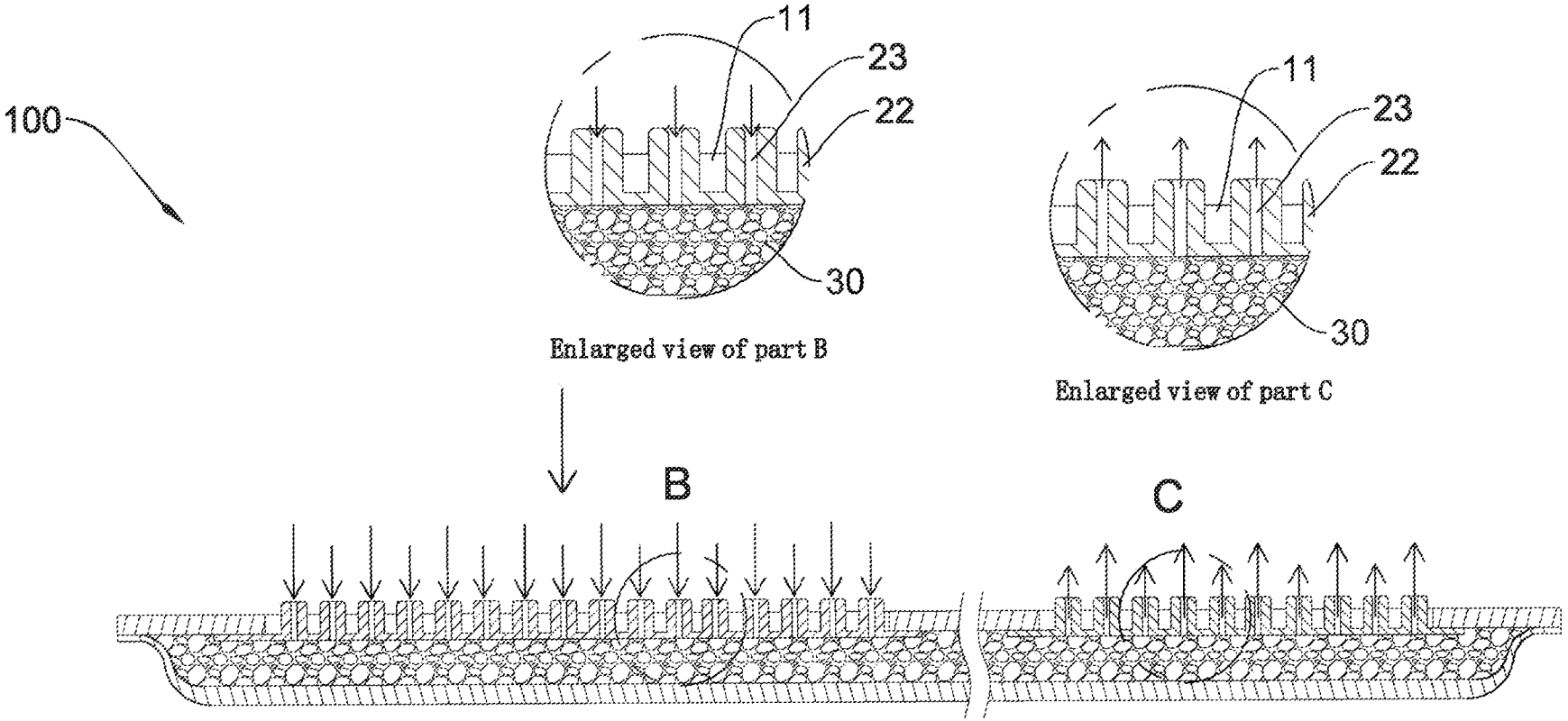
FIG. 3 is a cross sectional view showing the operation of the insole/sole structure according to the first embodiment of the present invention.
Figure 4:
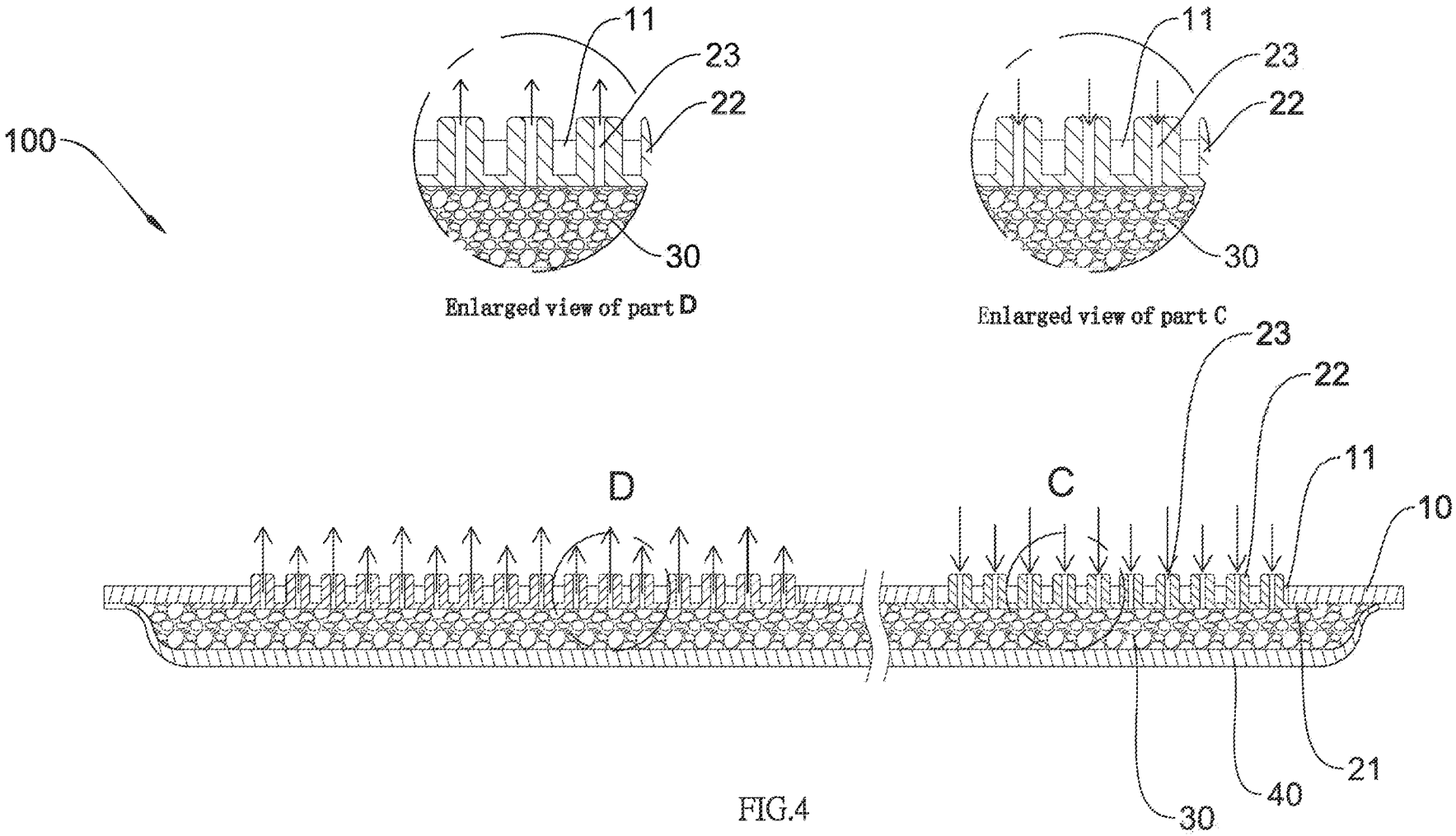
FIG. 4 is another cross sectional view showing the operation of the insole/sole structure according to the first embodiment of the present invention.

As illustrated in FIGS. 1, 3 and 4, a profile of the foam pad 30 and a profile of the bottom pad 40 correspond to a profile of the top pad 10, such that when the foam pad 30 and the bottom pad 40 are connected, the foam pad 30 and the bottom pad 40 are closed, and the respective one massage column module 20 is limited between the top pad 10 and the foam pad 30, wherein the foam pad 30 includes multiple air-permeable bores defined thereon so that when the multiple flexible massaging columns 22 of the respective one massage column module 20 are pressed, airs flow to the foam pad 30.

With reference to FIGS. 3-4, when walking on a ground, the heel of the foot steps the ground and the sole of the foot remove from the ground, hence the heel steps the multiple flexible massaging columns 22 so that the airs flow into the foam pad 30 from the air orifice 23 of the respective one flexible column 22 and discharge out of the massage column module 20 of the sole of the foot or a connection surface of the foam pad 30, the bottom pad 40, and the top pad 10. Thereafter, the sole steps the multiple flexible massaging columns 22 so that the airs discharge out of the massage column module 20 of the heel of the foot, thus circulating the airs to cool the foot when walking with the insole/sole structure 100.

Figure 5:
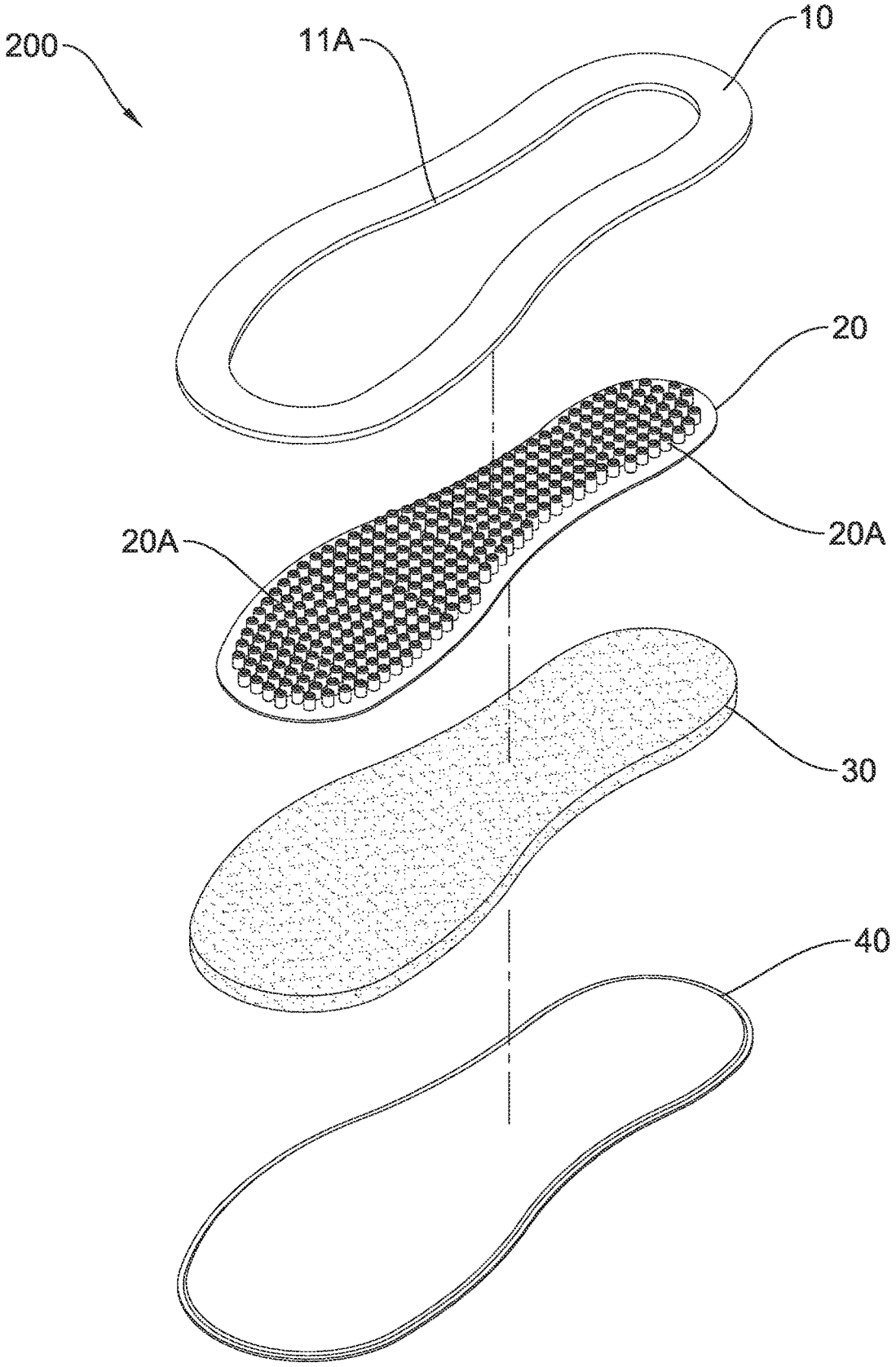
FIG. 5 is a perspective view showing the exploded components of the insole/sole structure according to a second embodiment of the present invention.
Figure 6:
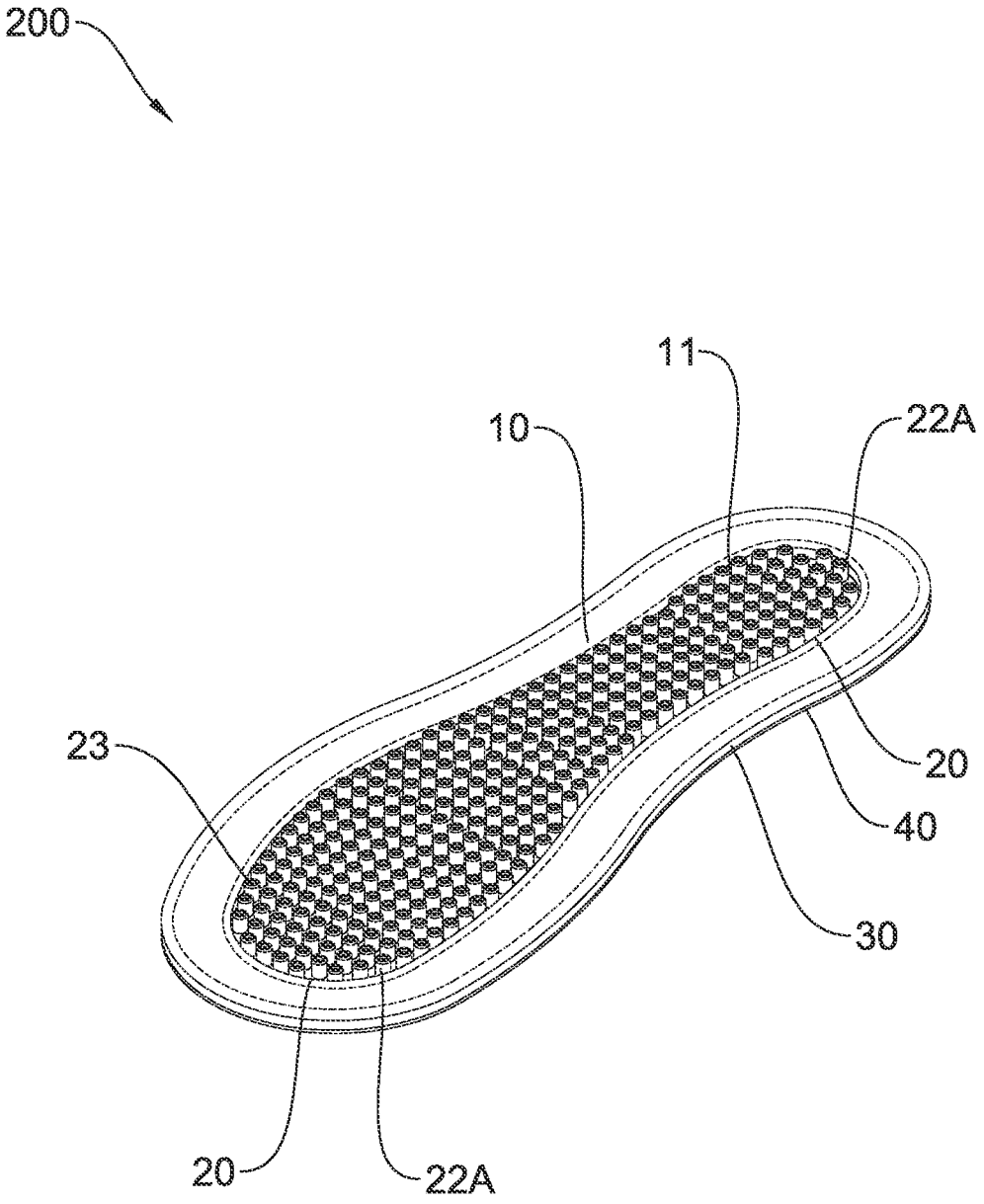
FIG. 6 is a perspective view showing the assembly of the insole/sole structure according to the second embodiment of the present invention.

Referring to FIGS. 5-6, a difference of an insole/sole structure 200 of a second embodiment of the present invention from that of the first embodiment comprises: an accommodation groove 11 defined on the top pad 10 and corresponding to a profile of a connection of a sole, an arch, and a heel of the foot, wherein multiple flexible massaging columns 22A are arranged on a massage column module 20 to correspond to the accommodation groove 11, wherein the multiple flexible massaging columns 22A have a same height or some of the multiple flexible massaging columns 22A corresponding to the arch of the foot are higher than the other flexible massaging columns 22A corresponding to the sole and the heel of the foot, such that the insole/sole structure 200 massages and cools the foot and absorbs vibration when walking. Preferably, some flexible massaging columns 22A are capable of supporting and correcting the foot.

Figure 7:
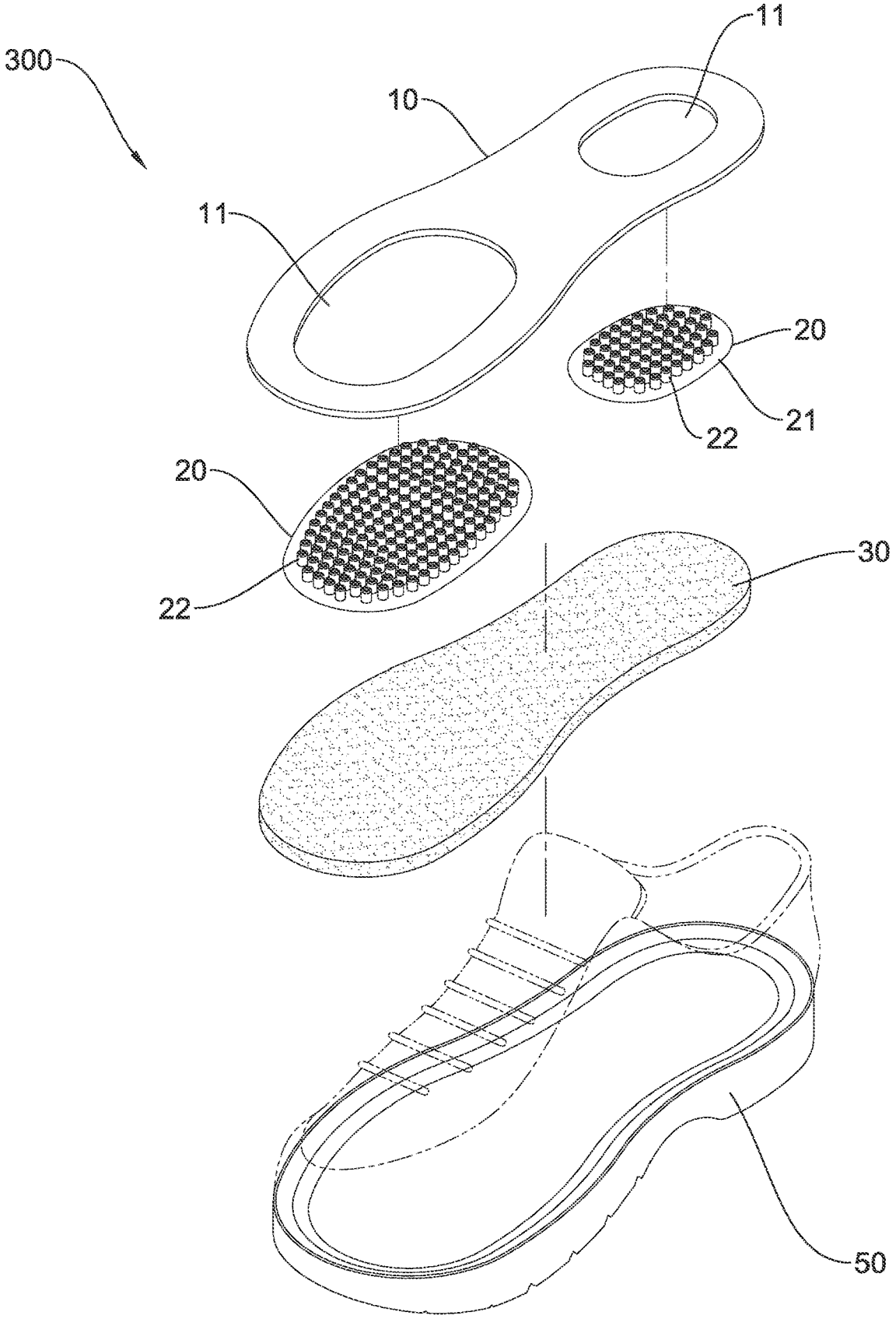
FIG. 7 is a perspective view showing the exploded components of the insole/sole structure according to a third embodiment of the present invention.
Figure 8:
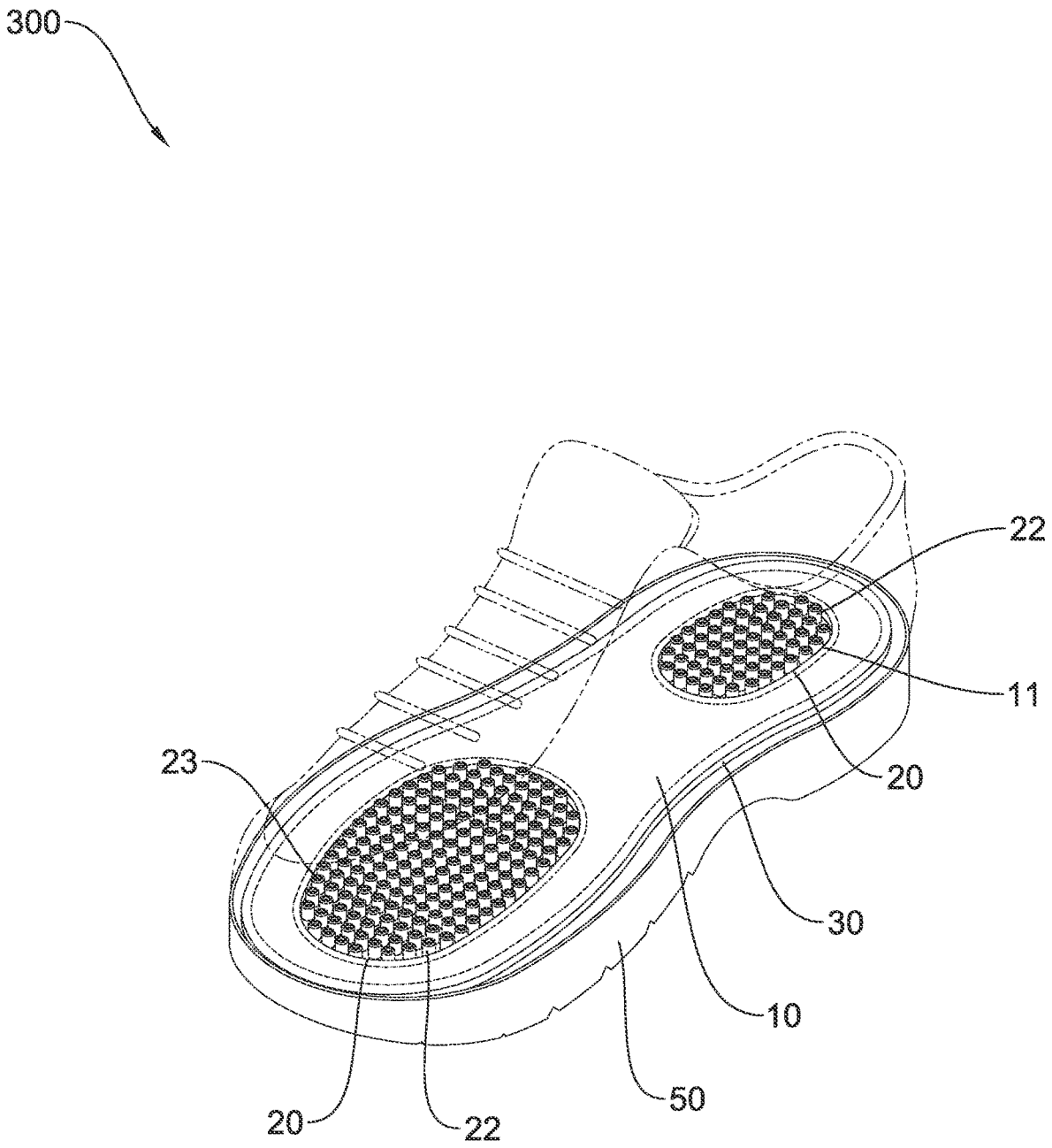
FIG. 8 is a perspective view showing the assembly of the insole/sole structure according to the third embodiment of the present invention.

Referring to FIGS. 7-8, a difference of an insole/sole structure 300 of a third embodiment of the present invention from that of the first embodiment comprises: a shoe sole 50 configured to replace the bottom pad 40 of the first embodiment, such that the shoe sole 50 accommodates the top pad 10, the two massage column modules 20, and the form pad 30 and is connected with a vamp directly, thus enhancing a productive efficiency.

While the preferred embodiments of the invention have been set forth for purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An insole/sole structure comprising: a top pad, two massage column modules, a form pad, and a bottom pad;

wherein the top pad is formed in a foot shape and includes at least one accommodation groove defined on the top pad;

wherein a respective one massage column module of the at least one massage column module includes a holding portion and multiple flexible massaging columns, and the holding portion of the respective one massage column module is configured to hold the multiple flexible massaging columns of the respective one massage column module, the respective one massage column module is connected on a bottom of the top pad by using the holding portion, wherein the multiple flexible massaging columns are held on the holding portion to correspond to a profile of a respective one accommodation groove of the at least one accommodation groove, such that when a respective one flexible massaging column is connected with the top pad, the multiple flexible massaging columns extend out of the respective one accommodation groove of the top pad;

wherein a profile of the foam pad and a profile of the bottom pad correspond to a profile of the top pad, such that when the foam pad and the bottom pad are connected, the foam pad and the bottom pad are closed, and the respective one massage column module is limited between the top pad and the foam pad, wherein the foam pad includes multiple air-permeable bores defined thereon so that when the multiple flexible massaging columns of the respective one massage column module are pressed, airs flow to the foam pad;

wherein when a heel and a sole of a foot step the multiple flexible massaging columns, the multiple flexible massaging columns massage the foot, and the airs flow to the foam pad from the multiple flexible massaging columns successively based on a stepping order to obtain a cooling effect to the foot.

2. The insole/sole structure as claimed in claim 1, wherein a respective one flexible column has an air orifice defined on a center thereof so that the airs flow into the foam pad from the air orifice of the respective one flexible column and discharge out of the massage column module of the sole or the heel of the foot.

3. The insole/sole structure as claimed in claim 1, wherein the top pad has two accommodation grooves corresponding to the sole and the heel of the foot.

4. The insole/sole structure as claimed in claim 1, wherein an accommodation groove is defined on the top pad and corresponds to a profile of a connection of a sole, an arch, and a heel of the foot.

5. The insole/sole structure as claimed in claim 1, wherein the bottom pad is replaced by a shoe sole.

6. The insole/sole structure as claimed in claim 1, wherein the multiple flexible massaging columns have a same height.

7. The insole/sole structure as claimed in claim 1, wherein the multiple flexible massaging columns have different heights.

* * * * *